United States Patent [19]

Attwood et al.

[11] 3,976,412

[45] Aug. 24, 1976

[54] APPARATUS FOR MAKING FIBROUS SHEET MATERIAL

[75] Inventors: Brian William Attwood, Bristol; Denis Raymond Hicklin, Bath, both of England

[73] Assignee: Karl Kroyer St. Anne's Limited, Bristol, England

[22] Filed: June 6, 1975

[21] Appl. No.: 584,256

[30] Foreign Application Priority Data

July 16, 1974 United Kingdom ..... 31389/74

[52] U.S. Cl. ..... 425/81; 425/84

[51] Int. Cl.[2] ..... B29J 5/02

[58] Field of Search ..... 425/80, 81, 82, 83

[56] References Cited

UNITED STATES PATENTS

| | | | |
|---|---|---|---|
| 3,276,928 | 10/1966 | Pearson et al. | 425/83 X |
| 3,576,692 | 4/1971 | Hutz | 425/81 |
| 3,649,396 | 3/1972 | Carlsson | 425/81 X |
| 3,905,864 | 9/1975 | Curry et al. | 425/81 X |

*Primary Examiner*—J. Howard Flint, Jr.

*Attorney, Agent, or Firm*—Larson, Taylor and Hinds

[57] ABSTRACT

Apparatus for dry forming one or more fibrous layers on a forming surface to provide eventually fiberboard or paper in which the fibers are fed by carrier air to a distributor immediately above the forming surface. The rate of flow of the carrier air and its fiber concentration are adjusted to match the distributor requirements by removal of some of the carrier air in a cyclone separator upstream of the distributor. Any removed fibers are fed back into the remaining carrier air.

6 Claims, 1 Drawing Figure

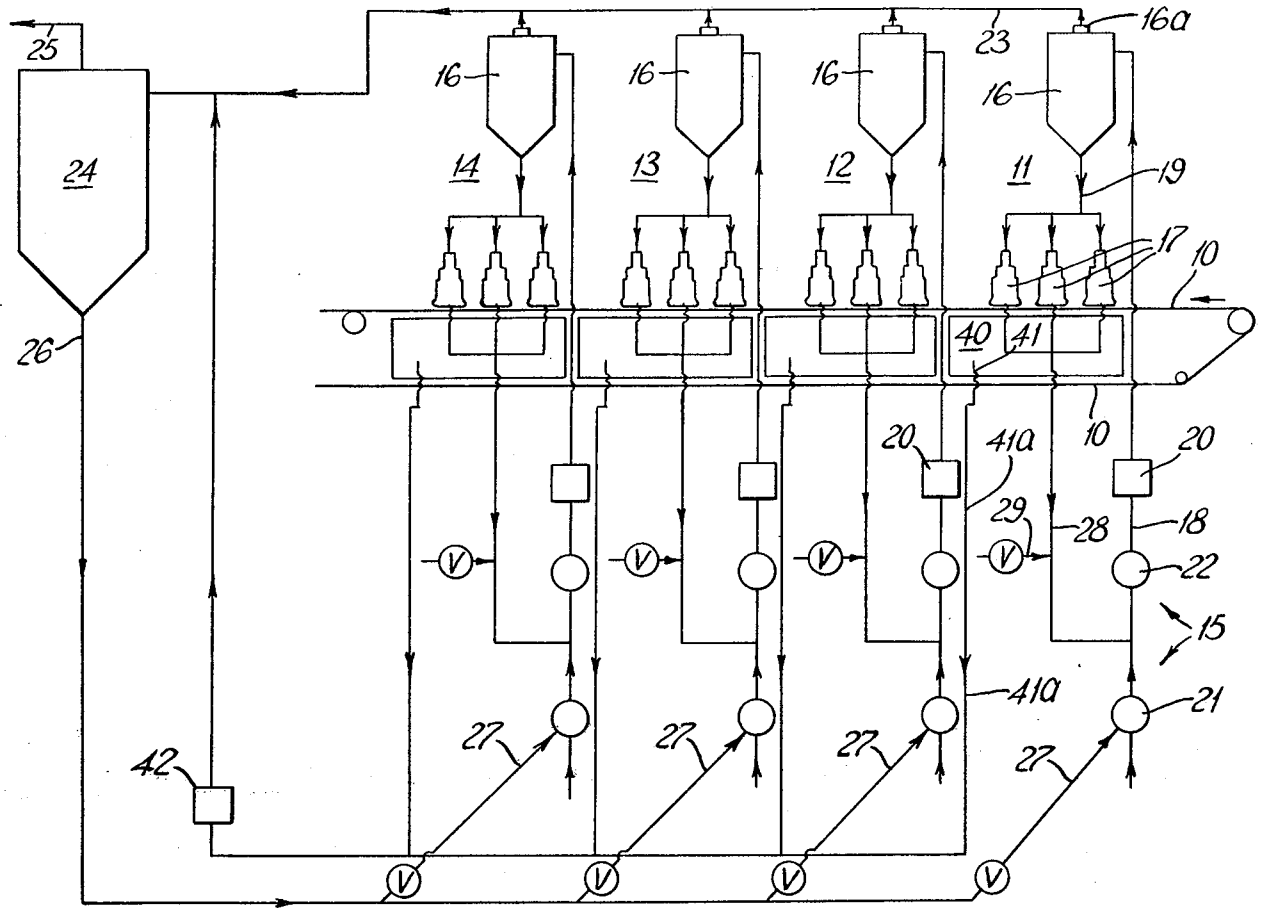
16a
19
17
10
20
18
22
15
21
23
16
11
10
28
41
40
41a
29
41a
27
12
13
14
24
25
26
42

APPARATUS FOR MAKING FIBROUS SHEET MATERIAL

This invention relates to apparatus for making fibrous sheet material and more particularly to apparatus for dry forming a layer of fibres on a forming surface.

In a typical method of dry forming a fibrous layer a dry fibrous raw material, e.g. wood cellulose, which has been disintegrated in a hammer mill into discrete fibres is conveyed in a stream of carrier air to a distributor to be laid on an air permeable forming surface, suction being applied to the underside of the forming surface to assist in the formation of the fibrous layer. The latter is sprayed with a binder, e.g. water, and then consolidated by heat and pressure for producing paper or board. If desired, suitable additives may be incorporated to produce a so-called non-woven product.

The distributor may comprise a housing with a perforated flat bottom wall above a forming surface which encloses a plurality of side-by-side impellers rotatable about vertical axes. The impellers which are located a short distance above the bottom wall distribute the fibres across the bottom wall, the fibres and their carrier air escaping downwards through the bottom wall. The fibres are sucked down to form a fibrous layer on the forming surface.

It has been found that the downward escape of all the carrier air through the perforated bottom wall can militate against the formation of a uniform layer on the forming surface. Furthermore, if the carrier air is initially required to cool the hammer mill it must have a minimum volume which results in a correspondingly excessive rate of flow through the distributor.

One object of the present invention is to control the volume and the rate of flow of the carrier air to a fibre distributor so as to match the operational requirements of the distributor.

A further object of the invention is to increase the fibre concentration in the carrier air.

The invention according to its simplest aspect provides apparatus for dry forming a layer of fibres on a forming surface comprising a plant for breaking up raw fibrous material, a forming surface, a distributor for distributing fibres on to the forming surface to form a layer thereon, and a fan air duct system for conveying fibres produced by the plant in a stream of carrier air to the distributor, characterised in that a primary separator device is located in the system between the plant and the distributor and arranged to remove part of the carrier air to reduce the volume and rate of flow of the remaining fibre-laden carrier air to match the operational requirements of the distributor.

By way of example the invention will now be described with reference to the accompanying diagrammatic drawing which shows a fibre feed and recycling system for dry forming a layer or layers of fibres.

Referring to FIG. 1, there is shown a permeable forming surface 10 provided by an endless wire belt on the upper run of which are to be deposited fibres to form dry fibrous layers. Four layers are successively deposited by sections 11–14, one on top of the other to form a multi-layer web. The four sections are similar in structure and operation and so only section 11 will now be described.

Section 11 for depositing the first layer of fibres on the forming surface 10 comprises a plant 15 for breaking up raw fibrous materials, a primary separator device in the form of a cyclone separator 16, three fibre distributors 17 arranged to be fed in parallel, and air ducting 18, 19 which includes a fan 20.

The plant 15 is made up of a bale breaker 21 and a hammer mill 22. Bales of fibre are fed to the bale breaker 21 to be broken up, they are then fed into the hammer mill 22. Here the resulting separated fibres are picked up by a stream of carrier air in the ducting 18 which has previously been used to cool the hammer mill and so has a correspondingly high volume and rate of flow which would be excessive for a fibre distributor.

The fibres are carried at the high rate of flow by the carrier air in ducting 18 to the primary cyclone separator 16 where some of the air is drawn off and discharged through an auxiliary outlet 16*a* and ducting 23 to a secondary separator device in the form of a cyclone separator 24, whilst the remainder of the carrier air and the fibres, now at a reduced rate of flow but with a higher concentration of fibres, leaves the separator 16 and flows along branched ducting 19 to reach the three fibre distributors 17 which deposit the fibres on the forming surface 10. The proportion of air removed at the separator 16 is chosen to reduce greatly the rate of flow of the carrier air entering the distributors 17 to a figure which matches or substantially matches the operational requirements of the distributors.

Meanwhile the carrier air removed by the primary cyclone separator 16 and which will normally contain a small proportion of fibres enters the secondary cyclone separator 24 where some of the air is removed from the fibres and vented to atmosphere through a duct 25. The fibres leave the separator 24 with the remainder of the carrier air and are carried by it along ducting 26 and valve-controlled branch ducting 27 to the bale breaker 21 of one of the sections 11–14, preferably that of section 12 or section 13 which provides an intermediate layer of fibres on the forming surface 10. It will be noted that the cyclone separator 24 forms part of a recycling system which is arranged to serve any of the sections 11–14 via the ducting 23, 26 and 27.

Any fibre which is fed to a distributor 17 but is not required for deposition on the forming surface is withdrawn through draw-off ducting 28 which connects with the interior of the distributor housing and is conveyed by a carrier air stream supplied through valve-controlled ducting 29 to the appropriate hammer mill 22. The ducting 29 may also be used to supply extra cooling air to the hammer mill 22.

The distributors 17 of each section cooperate with a suction box 40 to form a fibrous layer on the forming surface 10. Any fibres which may reach the suction box are removed through ducting 41 and carried by a stream of carrier air within ducting 41*a* via an air fan 42 to the ducting 23 to be fed to the secondary cyclone separator 24, together with the air and fibres drawn off by the primary cyclone separator 16.

The amount of carrier or cooling air being added through ducting 29, the operational speed of the plants 15, the speed of the carrier air fans 20 and 42, the selective operation of the cyclone separators 16 and 24, the linear speed of the forming surface 10, the rate at which the distributors 17 deposit the fibres, and the suction applied to the suction boxes 40, are all controllable to provide a balanced fan air duct system in which a continuous flow of fibre/air mixture is achieved throughout the apparatus so that no portions of the system are either starved or choked and continuous and efficient running can be achieved.

Referring to the whole apparatus, selective removal of a proportion of the carrier air by at least the four primary separators 16 allows the volume and rate of flow of the carrier air/fibres to the twelve distributors 17 to be matched to the individual operational requirements of the distributors 17. In addition, such removal provides a control of the fibre concentration for each distributor 17 and also allows the rate of flow of the carrier air to the four plants 15 to be matched to their individual operational requirements which are likely to differ from those of the distributors 17. It will be appreciated that the plants 15 may be modified, for example by omission of the bale breakers 21 if the raw material is in sheet form.

The apparatus illustrated may be modified as follows. Instead of a single secondary separator device 24, two or more cyclone separators may be used in series to increase the fibre concentration, especially in the supply to the sections 12, 13 for depositing the intermediate fibrous layers of the four superimposed layers. The cyclone separators 16, 24 may be replaced by other suitable separator devices for removal of part of the carrier air, e.g. in-line filters. Each section may have any suitable number of distributors 17. Typically, each section of the apparatus illustrated may have the following operational figures.

| | |
|---|---|
| Rate of flow of cooling/carrier air through hammer mill 22. | 1 cubic meter per second. |
| Fibre concentration at inlet to separator 16. | 0.05 gms per liter. |
| Fibre concentration at outlet of separator 16. | 0.5 gms per liter. |
| Rate of flow of carrier air at outlet of separator 16. | 0.1 cubic meter per second. |
| Thickness of layer deposited by each distributor 17. | 2 mm (approximately). |

If desired, the apparatus may be operated with less than four sections, e.g. with only section 11.

What we claim is:

1. Apparatus for dry forming a layer of fibres on a forming surface comprising a plant for breaking up raw fibrous material, a forming surface, a distributor for distributing fibres on to the forming surface to form a layer thereon, and a fan air duct system for conveying fibres produced by the plant in a stream of carrier air to the distributor, characterized in that a primary separator device is located in the system between the plant and the distributor and arranged to remove part of the carrier air to reduce the volume and rate of flow of the remaining fibre-laden carrier air to match the operational requirements of the distributor.

2. Apparatus as claimed in claim 1, wherein the fan air duct system is arranged to convey carrier air through the plant to cool it before conveying the carrier air to the primary separator device.

3. Apparatus as claimed in claim 1, wherein the primary separator device has an auxiliary outlet for the removed part of the carrier air, air ducting connects the auxiliary outlet to a secondary separator device for removing a further part of the carrier air received by it, and further air ducting is provided for conveying fibres received by the secondary separator device in their remaining carrier air to the fan air duct system upstream of the primary separator device.

4. Apparatus as claimed in claim 1, wherein the primary separator device is a cyclone separator.

5. Apparatus as claimed in claim 1, wherein there is a plurality of fibre distributors arranged to be fed in parallel by the fan air system and to distribute their respective fibre in succession on to the forming surface.

6. Apparatus for dry forming layers of fibre superimposed one on the other on a forming surface and comprising a. a movable forming surface, b. a plurality of dry-forming sections each comprising a plant for breaking up raw fibrous material, first ducting for conveying fibres produced by the plant in a stream of carrier air to a primary separator device which is arranged to remove part of the carrier air to reduce the volume and rate of flow of the remaining fibre-laden carrier air, the primary separator device having an auxiliary outlet for the removed part of the carrier air, and second ducting for conveying the fibres from the primary separator device in the remaining carrier air to a distributor arranged to distribute the fibres on to the forming surface to form a layer thereon, c. the distributors being disposed along the forming surface, d. third ducting which connects the auxiliary outlets of the primary separator devices to a secondary separator device, e. the secondary separator device being arranged to remove part of the carrier air received from the auxiliary outlets, f. and fourth ducting for conveying fibres received by the secondary separator device in their remaining carrier air to the first ducting of at least one of the sections, g. all the said ducting forming part of a fan air duct system.

* * * * *